United States Patent [19]

Kimura

[11] 4,369,967

[45] Jan. 25, 1983

[54] TRAINING AID FOR DRILLING MUSCLES

[76] Inventor: Akira Kimura, 1-25, Takenotsuka 3-chome, Adachi-ku, Tokyo, Japan

[21] Appl. No.: 249,596

[22] Filed: Apr. 1, 1981

[30] Foreign Application Priority Data

Dec. 29, 1980 [JP] Japan ..... 55-190040[U]

[51] Int. Cl.[3] ..... A63B 21/18

[52] U.S. Cl. ..... 272/119; 272/67

[58] Field of Search ..... 272/119, 67, 143, 117; 63/11, 3; 428/465

[56] References Cited

U.S. PATENT DOCUMENTS

| | | | |
|---|---|---|---|
| 991,256 | 5/1911 | Whilde | 428/465 |
| 2,017,071 | 10/1935 | Minor | 428/465 |
| 3,490,766 | 1/1970 | Gardner | 272/119 |
| 3,580,572 | 5/1971 | Stafford | 273/54 B |
| 4,197,720 | 4/1980 | Nani | 63/11 |

FOREIGN PATENT DOCUMENTS

| | | | |
|---|---|---|---|
| 354571 | of 1961 | Switzerland | 428/465 |
| 1210385 | 10/1970 | United Kingdom | 63/11 |

*Primary Examiner*—William H. Grieb
*Assistant Examiner*—William R. Browne
*Attorney, Agent, or Firm*—Lawrence I. Field

[57] ABSTRACT

A training aid for drilling muscles of a user comprises a rectangular lead plate which can be easily bent, and a cover member made of soft and resilient rubber. The lead plate is completely surrounded by the cover member. The training aid can be mounted on user's wrist, ankle, arm, leg, neck, etc. by bending the lead plate. More than one training aid can be piled one over another.

1 Claim, 4 Drawing Figures

TRAINING AID FOR DRILLING MUSCLES

BACKGROUND OF THE INVENTION

The present invention relates to a training aid for drilling muscles, and more particularly a training aid which can be detachably mounted around wrists, ankles, arms, legs, necks, etc. of users.

Such a training aid is commercially available. The known training aid comprises a bag made of canvas containing a number of small balls made of lead. Such a training aid is mounted around the wrist and ankle of a user and is fixed thereon by means of strings or bands. However, such a training aid could not be firmly mounted on the wrist and andle of user and thus, the user feels difficultry in use. Moreover, the amount of balls in the bag which constitute a load for training cannot be changed and thus, it is impossible to adjust the load or weight in accordance with muscle power of the user. Therefore, the user must prepare a plurality of training aids having different weights. Further, since the known training aid is fixed to the user by the strings or bands, when the strings or bands are loosened or disconnected, the training aid might be accidentally removed from the user. This is sometimes very dangerous.

SUMMARY OF THE INVENTION

The present invention has for its object to provide a novel and useful training aid for drilling muscles of users, which can be simply and firmly mounted around wrists, ankles, arms, legs, necks of users without using any fastening strings or bands and does not cause any difficulty for the users.

It is another object of the invention to provide a training aid in which a load for training can be easily adjusted at will.

According to the invention a training aid for drilling muscles of a user comprises A training aid for drilling muscles of a user comprising a flexible plate made of lead; and a cover member made of soft and resilient material such as rubber and synthetic resin and surrounding completely the plate, whereby the training aid is mounted around a user's part such as wrist, ankle, arm, leg and neck merely by bending the lead plate.

A preferred embodiment of the training aid according to the invention, further comprising at least one projection formed integrally with the cover member on one main surface of the training aid and at least one recess formed in the cover member on the other main surface of the training aid, whereby a plurality of training aids are piled one over another.

DESCRIPTION OF THE PREFERRED EMBODIMENTS

Figure 1:
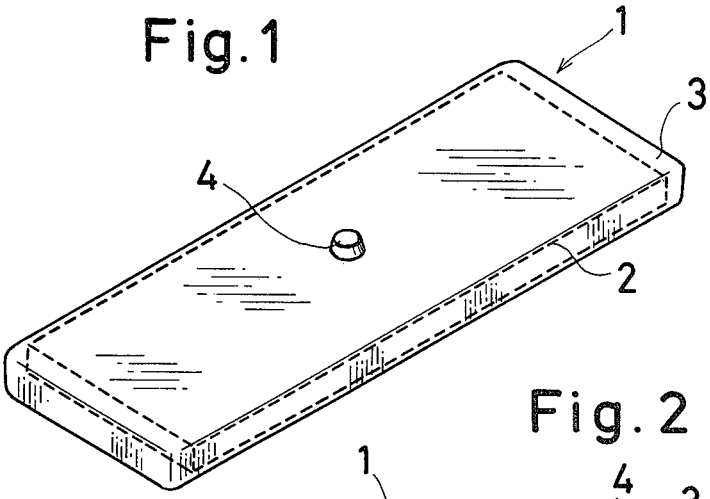
FIG. 1 is a perspective view showing an embodiment of the training aid according to the invention.
Figure 2:
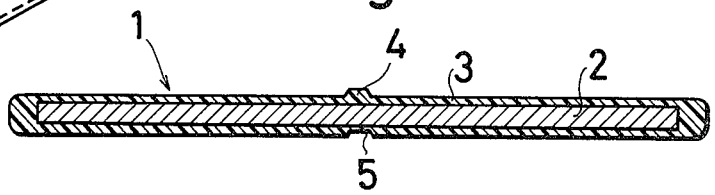
FIG. 2 is a cross section illustrating a construction of the training aid of FIG. 1.

FIGS. 1 and 2 illustrate an embodiment of the training aid according to the invention. The training aid 1 comprises a rectangular flexible plate 2 made of lead and a cover member 3 made of soft and resilient material such as rubber and synthetic resin for completely surrounding the plate 2. The lead plate 2 has such a thickness that it can be easily bent and can be deformed in a desired configuration. Therefore, the training aid 1 can be easily mounted around wrist, andle, arm, leg, neck, etc. of a user. On one main surface of the training aid 1 a projection 4 is formed integrally with the cover member 2 and on the other main surface there is formed a recess 5 at a position corresponding to the projection 4.

Figure 3:
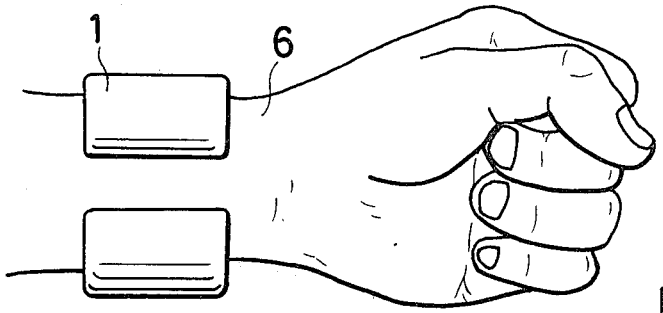
FIG. 3 is a perspective view depicting schematically the training aid mounted around a wrist of a user.

As shown in FIG. 3, upon using the training aid 1, the training aid 1 is made in contact with a wrist 6 of a user and is then bent to surround the wrist 6. In this manner the training aid 1 according to the invention can be easily mounted around the wrist 6 of user without fastening strings or bands. Under this condition, the user would not feel difficultry in use, because the lead plate 2 is fully covered with the soft and resilient cover member 3. Therefore, even if the user moves hard and violently with wearing the training aid 1, a skin of the wrist portion is not injuredat all.

As explained above the training aid 1 can be easily and firmly mounted around the wrist 6 of user merely by bending the lead plate 2 along a configuration of the wrist 6. Nevertheless the training aid 1 could hardly be removed from the wrist 6 unless the lead plate 2 is expanded.

Figure 4:
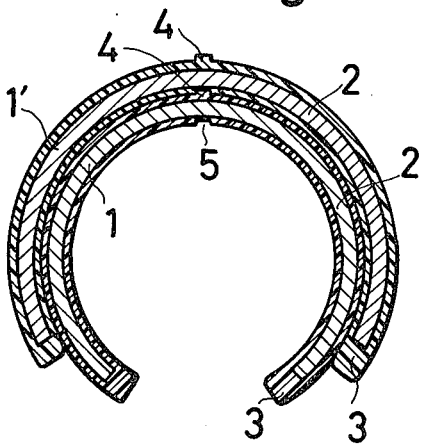
FIG. 4 is a cross section showing two training aids piled one over the other according to the invention.

When it is not sufficient to mount only one training aid, two trainingaids can be piled one over the other as illustrated in FIG. 4 with the projection 4 of the lower aid 1 being firmly inserted into the recess 5 of the upper training aid 1'. In this case, the two training aids 1 and 1' are coupled with each other and thus, could be hardly taken off the user during the training. It should be noted that it is much easier to mount the two aids to the user after being coupled with each other. Moreover, a third training aid of the same construction may be piled over the outer training aid 1'. In this manner the load for muscle power can be easily adjusted.

The present invention is not limited to the embodiment explained above, but various modifications can be conceived within the scope of the invention. For instance, more than one projections 4 and recesses 5 may be formed in the training aid to attain more positive coupling. Further, if it is not necessary to use more than one training aid one over another, the projection 4 and recess 5 may be omitted. In FIG. 4 the training aid 1 is mounted around the wrist 6, but may be secured to any ports of the user, such as ankle, arm, leg and neck. Further if the training aid has a sufficient length, it may be mounted around the body or waist of user.

What is claimed is:

1. A training aid for drilling muscles of a user comprising:

a flexible plate made of lead; and a cover member made of soft and resilient material such as rubber and synthetic resin and completely surrounding the plate;

at least one projection formed integrally with the cover member on one main surface of the training aid and at least one recess formed in the cover member on the other main surface of the training aid whereby a plurality of training aids are piled one over another and the training aid is mounted around a user's part such as wrist, ankle, arm, leg and neck merely be bending the lead plate.

* * * * *